US010931016B2

(12) United States Patent
Yun

(10) Patent No.: US 10,931,016 B2
(45) Date of Patent: Feb. 23, 2021

(54) THREE-DIMENSIONAL INVERTED-F ANTENNA ELEMENT AND ANTENNA ASSEMBLY AND COMMUNICATION SYSTEM HAVING THE SAME

(71) Applicant: TE CONNECTIVITY CORPORATION, Berwyn, PA (US)

(72) Inventor: Xing Yun, Harrisburg, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 126 days.

(21) Appl. No.: 16/152,655

(22) Filed: Oct. 5, 2018

(65) Prior Publication Data

US 2020/0112101 A1 Apr. 9, 2020

(51) Int. Cl.

| | |
|---|---|
| ***H01Q 1/32*** | (2006.01) |
| ***H01Q 1/42*** | (2006.01) |
| ***H01Q 9/04*** | (2006.01) |
| ***H01Q 5/357*** | (2015.01) |
| ***H01Q 1/12*** | (2006.01) |
| ***H01Q 1/38*** | (2006.01) |
| ***H01Q 9/42*** | (2006.01) |
| ***H01Q 21/28*** | (2006.01) |

(52) U.S. Cl.

CPC ..... *H01Q 9/0421* (2013.01); *H01Q 1/1214* (2013.01); *H01Q 1/32* (2013.01); *H01Q 1/38* (2013.01); *H01Q 1/42* (2013.01); *H01Q 5/357* (2015.01); *H01Q 9/42* (2013.01); *H01Q 21/28* (2013.01)

(58) Field of Classification Search

CPC .... H01Q 9/0421; H01Q 5/357; H01Q 9/0407; H01Q 5/0055; H01Q 1/38; H01Q 1/42; H01Q 9/42; H01Q 21/28; H01Q 1/1214; H01Q 1/32; H01Q 9/04

USPC ..... 343/702

See application file for complete search history.

(56) References Cited

U.S. PATENT DOCUMENTS 7,242,352 B2 * 7/2007 Tavassoli Hozouri ..... H01Q 9/0421 343/700 MS 8,106,835 B2 * 1/2012 Chien ..... H01Q 5/371 343/700 MS (Continued)

OTHER PUBLICATIONS

Hirano et al. "Doual-BAnd Printed Inverted-F Antenna with a Nested Structure" Progress in Electromagnetics Research Letters; vol. 61; 2016 (6 pages).

(Continued)

*Primary Examiner* — Hai V Tran

(57) ABSTRACT

Three-dimensional inverted-F antenna (3D-IFA) includes a coupling section that is configured to electrically connect to a ground plane through a short point and electrically connect to a communication line through a feed point. The coupling section extends along a section plane that intersects the short point and the feed point. The coupling section extends away from the short and feed points along the Z-axis. The 3D-IFA element also includes an antenna arm that extends lengthwise from the coupling section along an XY plane. The antenna arm follows an arm path along the XY plane as the antenna arm extends from the coupling section to a distal edge of the antenna arm. The arm path is non-linear along the XY plane, wherein at least a portion of the arm path extends away from the section plane.

20 Claims, 8 Drawing Sheets

(56) References Cited

U.S. PATENT DOCUMENTS

| | | | | |
|---|---|---|---|---|
| 8,502,748 | B2 * | 8/2013 | Liang | H01Q 9/0421 343/702 |
| 8,933,843 | B2 * | 1/2015 | Pan | H01Q 1/243 343/702 |
| 10,411,330 | B1 * | 9/2019 | Yun | H01Q 1/48 |
| 2004/0145529 | A1 | 7/2004 | Iguchi et al. | |
| 2012/0146854 | A1 | 6/2012 | Ishikawa | |
| 2014/0292593 | A1 | 10/2014 | Thiam et al. | |
| 2015/0071137 | A1 * | 3/2015 | Thiam | H04B 7/0413 370/297 |

OTHER PUBLICATIONS

Gonzalez "Dual Polarized Omnidirectional Array Element for MIMP Systems" KTH Signals, Sensors and Systems; 2005 (67 pages).
Sun et al. "Low-Profile Omnidirectional Antenna with Dual Polarizations for 2.4 GHz WLAN Applications" Progress in Electromagnetics Research Letters; vol. 65; 2017 (6 pages).
Liu et al. "A Compact Omnidirectional Dual-Polarized Antenna for 2A-GHz WLAN Applications with Highly Isolated Orthogonal Slots" Progress in Electromagnetics Research C vol. 43; 2013 (15 pages).
King et al. "Transmission-Line Missile Antennas" Case No. 671.01; 1958 (26 pages).
Hossain et al. "High Gain Inverted-F and Loaded Inverted-F Antennas for WLAN/Wi-Fi Applications" ACEEE International Journal on Communications; vol. 03, No. 01; 2012 (5 pages).
Intelsat "Circular Polarization vs. Linear Polarization" Intelsat (5 pages).
International Search Report, International Application No. PCTIB2019/058175, International Filing Date, Sep. 26, 2019.

* cited by examiner

THREE-DIMENSIONAL INVERTED-F ANTENNA ELEMENT AND ANTENNA ASSEMBLY AND COMMUNICATION SYSTEM HAVING THE SAME

BACKGROUND

The subject matter relates generally to an antenna assembly and a communication system having an antenna element that has a reduced size and/or that is designed to limit its effect on a nearby antenna element.

More and more commercial products and systems are being designed to communicate wirelessly. In some cases, a system may be configured to communicate through multiple frequency bands to provide multiple wireless services. For example, a modern motor vehicle may have ten (10) or more antennas that provide wireless services for broadcast radio, satellite radio, television, global navigation satellite system (GNSS) communication, remote start, remote entry, electronic toll collection, long-term evolution (LTE) communication, Wi-Fi communication, and vehicle-to-vehicle communication. The antennas can be installed at various locations. One challenge is the directional nature of an antenna element and its limited abilities to pick up signals when the vehicle is in a certain orientation. One solution includes installing several antennas at different locations so that, regardless of the vehicle's orientation, at least one of the antennas is positioned properly for wireless communication. But using several different locations for antennas may not be cost-effective and can possibly make the vehicle less aesthetically appealing.

Another solution includes installing an integrated communication module on the rooftop of the motor vehicle. The communication module has multiple antenna elements that are designed for communicating in particular frequency bands. On the rooftop, signal reception is not dependent on the orientation of the motor vehicle. To minimize drag and increase the overall aesthetic appeal of the vehicle, the communication module is typically small and has a particular shape required by manufacturers. For example, a manufacturer may require that the communication module have a maximum height that is at most 40-50 millimeters.

It can be challenging to position multiple antenna elements within the limited space of the communication module while achieving the desired performance for the different antennas. Energy radiated by one antenna may be absorbed by a nearby antenna in a process referred to as coupling. This coupling can affect the radiation gain and pattern of the antenna and reduce the overall performance. Similarly, it may also be difficult for an antenna element to receive RF waves when shadowed by another antenna element. For example, planar inverted-F antennas (PIFAs) may block or "shadow" one or more other antenna elements (e.g., patch antennas) that are near the PIFA.

Accordingly, there is a need for an antenna element that occupies less space than other conventional antenna elements and/or that does not significantly reduce the performance of an adjacent antenna element.

BRIEF DESCRIPTION

In an embodiment, a three-dimensional inverted-F antenna (3D-IFA) element is provided. The 3D-IFA element is oriented with respect to mutually perpendicular X-, Y-, and Z-axes. The 3D-IFA element includes a coupling section that is configured to electrically connect to a ground plane through a short point and electrically connect to a communication line through a feed point. The coupling section extends along a section plane that intersects the short point and the feed point. The coupling section extends away from the short and feed points along the Z-axis. The 3D-IFA element also includes an antenna arm that extends lengthwise from the coupling section along an XY plane. The antenna arm follows an arm path along the XY plane as the antenna arm extends from the coupling section to a distal edge of the antenna arm. The arm path is non-linear along the XY plane, wherein at least a portion of the arm path extends away from the section plane.

In some aspects, the arm path has a first path direction along the XY plane at a first cross-section of the antenna arm and has a second path direction along the XY plane at a second cross-section of the antenna arm. The first and second path directions may be at least perpendicular with respect to each other. Optionally, the first and second path directions are opposite path directions or approximately opposite path directions.

In some aspects, the antenna arm may have a designated length such that a current null exists along the antenna arm for a designated frequency band of the 3D-IFA element. Optionally, the antenna arm may be configured to provide a circular polarization component when a standing wave exists between the current null and the distal edge.

In some aspects, the 3D-IFA element may have a maximum area along the XY plane that defines a maximum width and a maximum depth of the 3D-IFA element. The maximum depth may be greater than the maximum width. The antenna arm may have a length that is at least two times (2×) the maximum depth of the 3D-IFA element.

In some aspects, the antenna arm has a first elevated edge and a second elevated edge and opposite first and second broad sides defined between the first and second elevated edges. The antenna arm may be oriented such that the first and second broad sides extend along the Z-axis and the first and second elevated edges have different elevations with respect to the ground plane. Optionally, the first elevated edge is closer to the ground plane than the second elevated edge. The first elevated edge may extend parallel to the XY plane. The coupling section may extend between the first elevated edge and the ground plane along the Z-axis. Also optionally, the 3D-IFA element may include a conductive sheet that includes the antenna arm and the coupling section. The conductive sheet may be folded along the antenna arm such that the antenna arm includes multiple arm sections in which adjacent arm sections are coupled by a joint.

In an embodiment, an antenna assembly is provided that includes a ground plane and an adjacent antenna element configured to transmit/receive energy for communicating wirelessly. The antenna assembly also includes a three-dimensional inverted-F antenna (3D-IFA) element oriented with respect to mutually perpendicular X-, Y-, and Z-axes. The 3D-IFA element includes a coupling section that is configured to electrically connect to the ground plane through a short point and electrically connect to a communication line through a feed point. The coupling section extends along a section plane that intersects the short point and the feed point. The coupling section extends away from the short and feed points along the Z-axis. The 3D-IFA element also includes an antenna arm extending lengthwise from the coupling section along an XY plane. The antenna arm follows an arm path along the XY plane as the antenna arm extends from the coupling section to a distal edge of the antenna arm. The arm path is non-linear along the XY plane, wherein at least a portion of the arm path extends away from the section plane.

In some aspects, the arm path has a first path direction along the XY plane at a first cross-section of the antenna arm and has a second path direction along the XY plane at a second cross-section of the antenna arm. The first and second path directions may be at least perpendicular with respect to each other.

In some aspects, the 3D-IFA element includes a conductive sheet that has the antenna arm and the coupling section. The conductive sheet may be folded along the antenna arm such that the antenna arm includes multiple arm sections in which adjacent arm sections are coupled by a joint.

In some aspects, the antenna arm has a designated length such that a current null exists along the antenna arm for a designated frequency band of the 3D-IFA element.

In some aspects, the 3D-IFA element has a maximum area along the XY plane that defines a maximum width and a maximum depth of the 3D-IFA element. The maximum depth may be greater than the maximum width, wherein the antenna arm has a length that is at least two times (2×) the maximum depth of the 3D-IFA element.

In some aspects, the adjacent antenna element has an antenna section that extends along an XY plane that is parallel to the ground plane.

In some aspects, the 3D-IFA element and the adjacent antenna element are configured to communicate within respective frequency bands that are separated by less than 20 MHz.

In an embodiment, a communication module is provided that is configured to be positioned along an exterior of a vehicle. The communication module includes a primary antenna element configured to be operable for receiving and transmitting communication signals within one or more cellular frequency bands, a secondary antenna element configured to be operable for receiving communication signals within one or more cellular frequency bands, and a satellite antenna element configured to be operable for receiving communication signals within a satellite frequency band. The satellite antenna element is positioned adjacent to the secondary antenna element. The satellite antenna element has an antenna section. The primary antenna element, the secondary antenna element, and the satellite antenna element are oriented with respect to mutually perpendicular X-, Y-, and Z-axes. The antenna section of the satellite antenna element extends parallel to an XY plane. The secondary antenna element has a three-dimensional inverted-F antenna (3D-IFA) antenna element. The 3D-IFA antenna element includes a coupling section that is configured to electrically connect to a ground plane through a short point and electrically connect to a communication line through a feed point. The coupling section extends along a section plane that intersects the short point and the feed point. The coupling section extends away from the short and feed points along the Z-axis. The 3D-IFA element also includes an antenna arm extending lengthwise from the coupling section along an XY plane, wherein the antenna arm follows an arm path along the XY plane as the antenna arm extends from the coupling section to a distal edge of the antenna arm. The arm path is non-linear along the XY plane. At least a portion of the arm path extends away from the section plane.

In some aspects, the 3D-IFA element and the satellite antenna element are configured to communicate within respective frequency bands that are separated by less than 20 MHz.

In some aspects, the communication module also includes a cover and a base plate that are coupled to one another. The secondary antenna element, the satellite antenna element, and at least a portion of the primary antenna element are positioned within an interior space between the cover and the base plate. Optionally, the cover has a maximum height that does not exceed 50 millimeters.

DETAILED DESCRIPTION

Figure 9:
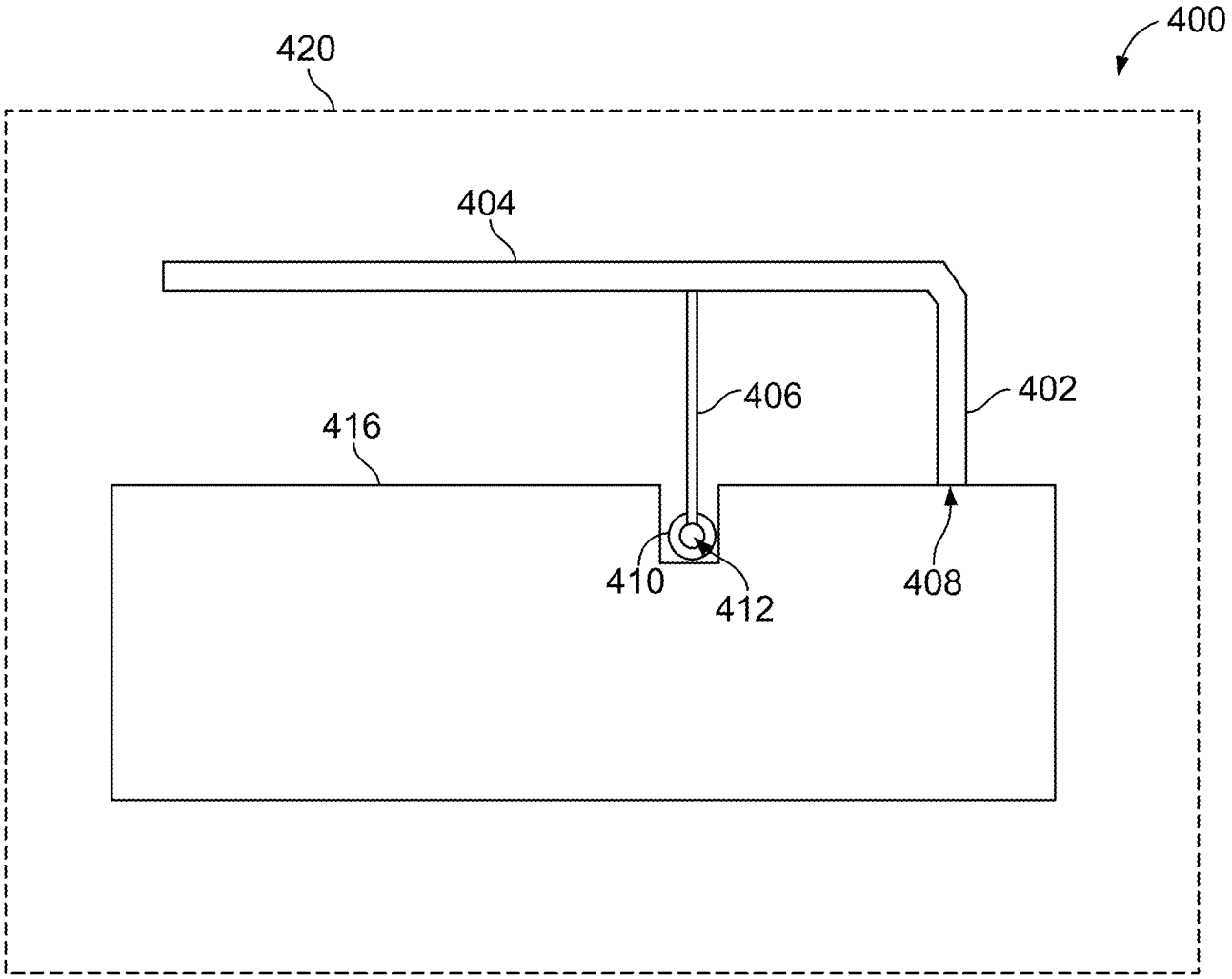
FIG. 9 is a side view of a conventional inverted-F (IFA) element.

Embodiments set forth herein include an antenna element, an antenna assembly having at least two antenna elements, and a communication system having the same. Embodiments include an antenna element having a three-dimensional inverted-F element (hereinafter referred to as the 3D-IFA element). FIG. 9 illustrates a conventional inverted-F (IFA) element 400. The IFA element 400 includes a ground leg 402, an antenna arm 404, and a feed leg 406. The ground leg 402 is grounded (e.g., to a ground plane 416) at a ground point 408. The feed leg 406 extends from an intermediate point along the arm 404 and is electrically connected to a communication line 410 (e.g., transmission line) at a feed point 412. As shown in FIG. 9, the ground leg 402, the antenna arm 404, and the feed leg 406 coincide with a common plane 420 (extends along the page). In other words, a conventional IFA element has a two-dimensional (2D) structure.

Unlike a conventional IFA element in which a common plane coincides with the antenna arm, the ground leg, and the feed leg, the antenna arm of the 3D-IFA element, described herein, is oriented such that at least a portion of the antenna arm extends away from the plane that coincides with the feed leg and the base leg. The 3D-IFA element may enable designs that have a smaller dimension.

The 3D-IFA element is configured to be operable within at least one frequency band. In particular embodiments, the 3D-IFA element may be a multi-band element that is operable within two or more frequency bands. For example, the frequency bands may be associated with cellular communications, such as AMPS/GSM850, GSM900, GSM1800, PCS/GSM1900, UMTS/AWS, GSM850, GSM1900, AWS, LTE (e.g., 4G, 3G, other long-term evolution (LTE) generation, B17 (LTE), LTE (700 MHz), etc.), AMPS, PCS, EBS (Educational Broadband Services), BRS (Broadband Radio Services), WCS (Broadband Wireless Communication Services/Internet Services), or other cellular frequency bandwidth(s). It should be understood, however, that the 3D-IFA elements, communication systems, and antenna assemblies described herein are not limited to a particular frequency band or frequency bands. Other frequency bands may be used. Likewise, it should be understood that antenna assembly described herein are not limited to particular wireless technologies or standards (e.g., LTE) and the antenna assembly may be designed to be suitable for other wireless technologies or standards.

In some embodiments, the 3D-IFA element is positioned adjacent to (or effectively co-located with) another antenna element (e.g., patch antenna). For example, the 3D-IFA element may be configured to reduce mutual coupling between the 3D-IFA element and the adjacent antenna element. The 3D-IFA element may be configured such that the 3D-IFA element does not significantly block or impair the adjacent antenna element from receiving RF waves from a predetermined frequency band or bands. Alternatively or additionally, the 3D-IFA element may be configured such that energy radiated by the adjacent antenna element is not substantially absorbed by the 3D-IFA element.

To this end, the 3D-IFA element includes an antenna arm that is generally orthogonal to the ground plane and/or a radiating surface of the adjacent antenna element. For example, the ground plane may be essentially parallel to an XY plane. The antenna arm may be essentially parallel to a Z-axis. The orthogonal orientation (or vertical orientation) of the antenna arm may have a minimized scattering impact on the adjacent antenna elements (e.g., patch antennas). Moreover, the orthogonal orientation may permit a designated surface area that enables bandwidths in both low and high bands. The vertical orientation and the non-planar structure of the antenna element may also reduce an aperture size of the 3D-IFA element that may shadow the adjacent antenna element.

Alternatively or in addition to the orientation of the antenna arm, the 3D-IFA element may have a non-planar structure that generates a designated circular polarization component (CP component). The designated CP component may reduce the 3D-IFA element's impact on the adjacent antenna element. For example, one of the antenna elements (e.g., the 3D-IFA element) may have a right-hand circular polarization (RHCP) component and the other antenna element (e.g., the adjacent antenna element) may have a left-hand circular polarization (LHCP) component.

For embodiments with multiple antenna elements, the 3D-IFA element may be configured to operate within one or more designated frequency bands that are near a frequency band that the adjacent antenna element operates within. For example, the 3D-IFA element may be configured to operate in a long-term evolution (LTE) band. The LTE higher frequency band includes 2350-2360 megahertz (MHz) and is adjacent to satellite frequency bands (e.g., between 2332.5 and 2345.0 megahertz (MHz)). When operating in the LTE higher frequency band, the 3D-IFA element may form two resonating structures. One of the resonating structures may be a quarter-wavelength IFA and may be vertically polarized, and the other resonating structure may be a half-wavelength standing wave and may have a designated CP component (e.g., RHCP component). Each of these polarizations may be orthogonal to the polarization of the adjacent antenna element. Orthogonal polarizations may be used to reduce the 3D-IFA element's impact on the adjacent antenna element. Without the 3D-IFA element's orthogonal polarizations, it could be necessary to further separate the antenna elements to achieve a similar performance. As such, the 3D-IFA element may enable more compact designs for communication systems that have multiple antenna elements, such as vehicular communication modules.

Although the embodiment illustrated in FIGS. 1-7 is particularly configured for the LTE higher frequency band and nearby satellite frequency bands, embodiments are not limited to this example. 3D-IFA elements, such as those described herein, may be designed to operate within other frequency bands and to reduce the 3D-IFA element's impact on other adjacent antenna elements.

Optionally, the communication system having the antenna assembly may be designed to reduce or minimize drag. For example, the communication system may include a cover that is low-profile and has a curved contour so that air may more easily flow over the cover (e.g., while a vehicle is moving) without causing a significant amount of fluid resistance. For example, the antenna assembly (not including any rod antennas) may have a height that is at most forty (40) millimeters (mm). It is contemplated, however, that embodiments set forth herein may have other sizes and/or other applications.

A variety of manufacturing methods exist for making the antenna elements. For example, the antenna elements may, at least in part, be formed by stamping and bending conductive metal sheets. Other manufacturing methods may include, for example, laser direct structuring (LDS), two-shot molding (dielectric with copper traces), three-dimensional (3D) printing, and/or ink-printing.

In the illustrated embodiment, the antenna assembly and/or the communication system includes a printed circuit board (PCB). The PCB may provide a base substrate (e.g., dielectric carrier) and also provide the ground plane and other conductive elements. Alternative base substrates, however, may be used, and a variety of manufacturing methods exist for making the base substrate. For example, the base substrate may be molded from a polymer material. For alternative designs, conductive elements may be first formed and then a dielectric material may be molded around the conductive components. The dielectric material may form a dielectric carrier that supports the antenna element. For example, the conductive elements may be stamped from sheet metal, disposed within a cavity, and then surrounded by a polymer material that is injected into the cavity. Alternatively, the dielectric carrier may be formed separately and the antenna element may be subsequently mounted to the dielectric carrier.

Embodiments may communicate within one or more radio-frequency (RF) bands. For purposes of the present disclosure, the term "RF" is used broadly to include a wide range of electromagnetic transmission frequencies including, for instance, those falling within the radio frequency, microwave, or millimeter wave frequency ranges. An RF band may also be referred to as a frequency band.

An antenna assembly may communicate through one or more frequency bands. In particular embodiments, the antenna assembly communicates through multiple frequency bands. For example, the communication system may be configured to communicate through amplitude-modulated (AM) radio waves, frequency-modulated (FM) radio waves, radio waves for global navigation satellite system (GNSS), radio waves for satellite digital audio radio service (SDARS), low-band radio waves for long-term evolution (LTE), and high-band radio waves for LTE. The communication system may utilize multiple-input multiple-output (MIMO) technology for communicating through LTE. In particular embodiments, the communication system is a vehicle roof top antenna module having four antenna elements.

Figure 1:
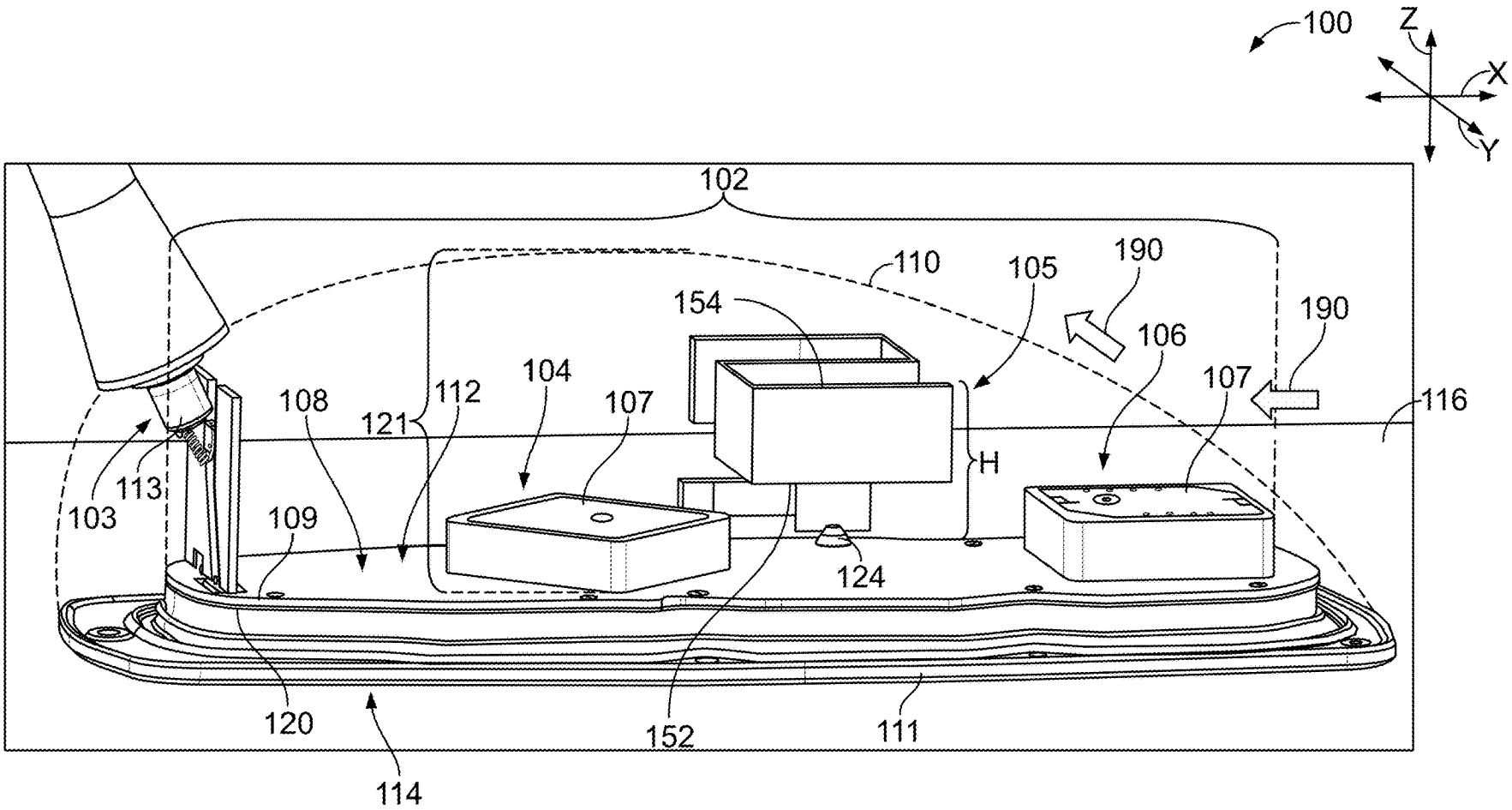
FIG. 1 is a perspective view of a communication system including an antenna assembly formed in accordance with an embodiment.

FIG. 1 is a perspective view of a communication system 100 formed in accordance with an embodiment. The communication system 100 and the components of the communication system 100 (e.g., antenna element 105) are oriented with respect to mutually perpendicular X-, Y-, and Z-axes. In an exemplary embodiment, the communication system 100 is mounted to an exterior of a larger system, such as a vehicle. In other embodiments, the communication system 100 may be disposed at least partially within or may include one or more components of the larger system. It should be understood, however, that the communication system 100 may be used for various applications and is not limited to vehicles.

The communication system 100 includes an antenna assembly 102 and a base substrate 108 having the antenna assembly 102 mounted thereon. Optionally, the communication system 100 may include a cover 110 that couples to the base substrate 108 and surrounds the antenna assembly 102. The cover 110 and the base substrate 108 define an interior space therebetween where the antenna assembly 102 is disposed. In particular embodiments, the cover 110 may be designed to reduce or minimize drag. For example, the cover 110 may have a low-profile and a curved contour so that air 190 may more easily flow over the cover 110 (e.g., while a vehicle is moving) without causing a significant amount of fluid resistance. For example, the cover 110 may have maximum height 121 that does not exceed 50 millimeters. In the illustrated embodiment, the communication system 100 has a mounting side 114 that is configured to be attached to the larger system, such as a rooftop of an automobile. The rooftop is represented by the metal surface 116 in FIG. 1.

The antenna assembly 102 includes a plurality of antenna elements 103-106. For example, the antenna element 103 may be a rod antenna configured for communicating through AM radio waves, FM radio waves, and one or more bands of LTE (e.g., for transmitting and/or receiving). The antenna element 103 includes an elongated flexible rod 113 having a length of, for example, 280 millimeters, although the length may be longer or shorter than 280 mm. In some embodiments, the antenna element 103 may be referred to as a primary antenna element (e.g., primary LTE antenna element) and may be operable for receiving and transmitting communication signals within one or more cellular frequency bands.

The antenna element 104 may operate as a satellite navigation system, such as a Global Navigation Satellite System (GNSS) receiver. The antenna element 105 may operate as a secondary antenna element (e.g., LTE, Rx receiving only). In particular embodiments, the antenna element 105 is a multi-band antenna capable of operating within multiple frequency bands. In particular embodiments, the antenna element 106 may be configured for satellite digital audio radio service (SDARS). As such, the antenna element 106 may be referred to as a satellite antenna element.

In the illustrated embodiment, the antenna elements 104 and 106 are patch antennas (e.g., ceramic patch antennas). Each of the antenna elements 104, 106 includes an antenna section 107 that is configured to excite energy for wireless communicating within a designated frequency band. The antenna section 107 may extend parallel to the XY plane (and a ground plane 120).

In the illustrated embodiment, the antenna element 105 is designed to reduce its impact on the antenna element 106. The antenna element 105 is a three-dimensional inverted-F antenna (3D-IFA) element and will be referred to as the 3D-IFA element 105. In the present specification and the claims, antenna elements other than the 3D-IFA element 105 may have different labels to more easily distinguish these antenna elements from the 3D-IFA element 105. For example, these antenna elements may be referred to as other antenna elements, adjacent antenna elements, GNSS elements, SDARS elements, patch antenna elements, etc.

The base substrate 108 is coupled to a ground plane 120 of the antenna assembly 102. At least one of the antenna elements 103-106 is grounded to the ground plane 120. In the illustrated embodiment, the base substrate 108 defines the mounting surface 112 to which the antenna elements are mounted. The 3D-IFA element 105 is configured to be electrically connected to the ground plane 120 at a short point (not shown) and electrically connect to a communication line (not shown) (e.g., the communication line 410 in FIG. 9) at a feed point 124.

In particular embodiments, the base substrate 108 and the ground plane 120 are provided by a printed circuit board (PCB) 109. For example, the ground plane 120 may be positioned under a dielectric layer of the base substrate 108. In other embodiments, the ground plane 120 may have a different position or level. For example, the ground plane 120 may be within the base substrate 108 or the ground plane may be defined by an element that is not attached to the base substrate. In some embodiments, the ground plane 120 may be electrically connected to an exterior metal surface 116 (e.g., rooftop of vehicle), which may operate as an infinitely large ground plane.

Optionally, the communication system 100 includes a base plate 111 that is configured to be mounted to the metal surface 116. The base plate 111 may be designed to attach to the cover 110 such that the base substrate 108 and the antenna assembly 102 are disposed within a unitary device or module. As such, the communication system 100 may constitute a communication module that is a unitary device designed to be mounted and communicatively coupled to a larger system. In particular embodiments, the communication module is a vehicular communication module that is configured to be mounted onto an exterior of the vehicle, such as the rooftop of the vehicle.

Although not shown, the communication system 100 may include system circuitry that modulates/demodulates the signals transmitted/received from the antenna assembly 102 and/or transmitted by the antenna assembly 102. The system circuitry may also include one or more processors (e.g., central processing units (CPUs), microcontrollers or other logic-based devices), one or more memories (e.g., volatile and/or non-volatile memory), and one or more data storage devices (e.g., removable storage device or non-removable storage devices, such as hard drives). The system circuitry may also include a wireless control unit (e.g., mobile broadband modem) that enables the communication system to communicate via a wireless network. The communication system may be configured to communicate according to one or more communication standards or protocols (e.g., LTE, Wi-Fi, Bluetooth, cellular standards, etc.).

During operation of the communication system 100, the communication system 100 communicates through the antenna elements 103-106 of the antenna assembly 102. To this end, the 3D-IFA element 105 is configured to exhibit electromagnetic properties that are designed for the desired application. For instance, the 3D-IFA element 105 may be configured to operate in one or more frequency bands. The structure of the 3D-IFA element 105 can be configured to effectively operate in particular frequency bands. The 3D-IFA element 105 may be configured to have designated performance properties, such as a voltage standing wave ratio (VSWR), gain, bandwidth, and a radiation pattern.

Figure 2A:
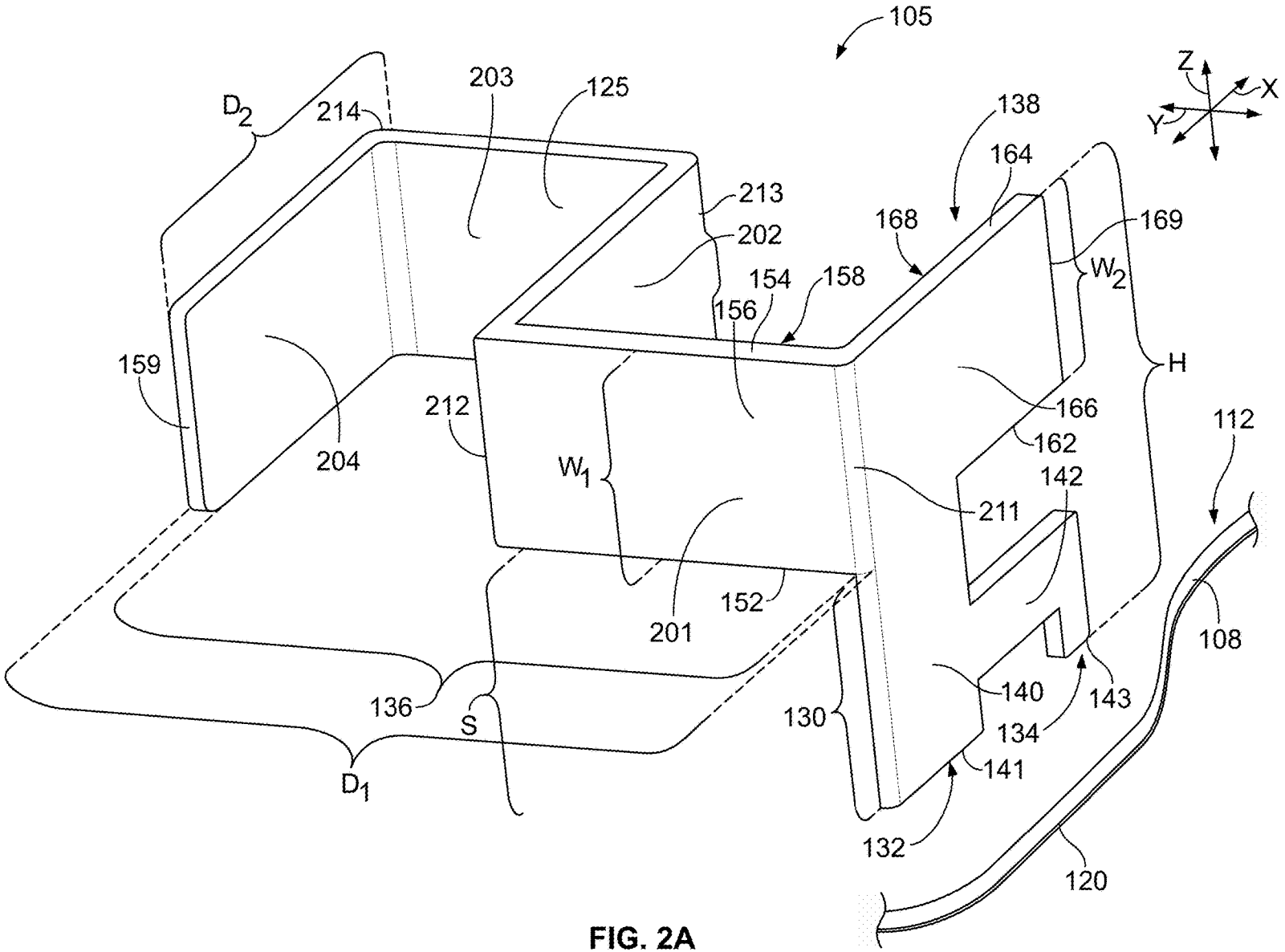
FIG. 2A is an isolated perspective view of a three-dimensional inverted-F antenna (3D-IFA) element that may be used standalone or with the communication system of FIG. 1.

FIG. 2A is an isolated perspective view of the 3D-IFA element 105 formed in accordance with an embodiment. The 3D-IFA element 105 is shaped such that the 3D-IFA element 105 may communicate (e.g., transmit and/or receive) at a desired level of performance. As shown, the 3D-IFA element 105 includes a coupling section 130 and at least one antenna arm 136, 138 that extends from the coupling section 130. As shown, the 3D-IFA element 105 is a single piece of conductive material (e.g., sheet metal). In particular embodiments, the single piece of conductive material is sheet metal that is bent to the desired shape. In other embodiments, however, the 3D-IFA element 105 may be formed using another method (e.g., ink-printed, 3D printing, LDS, etc.).

Figure 3:
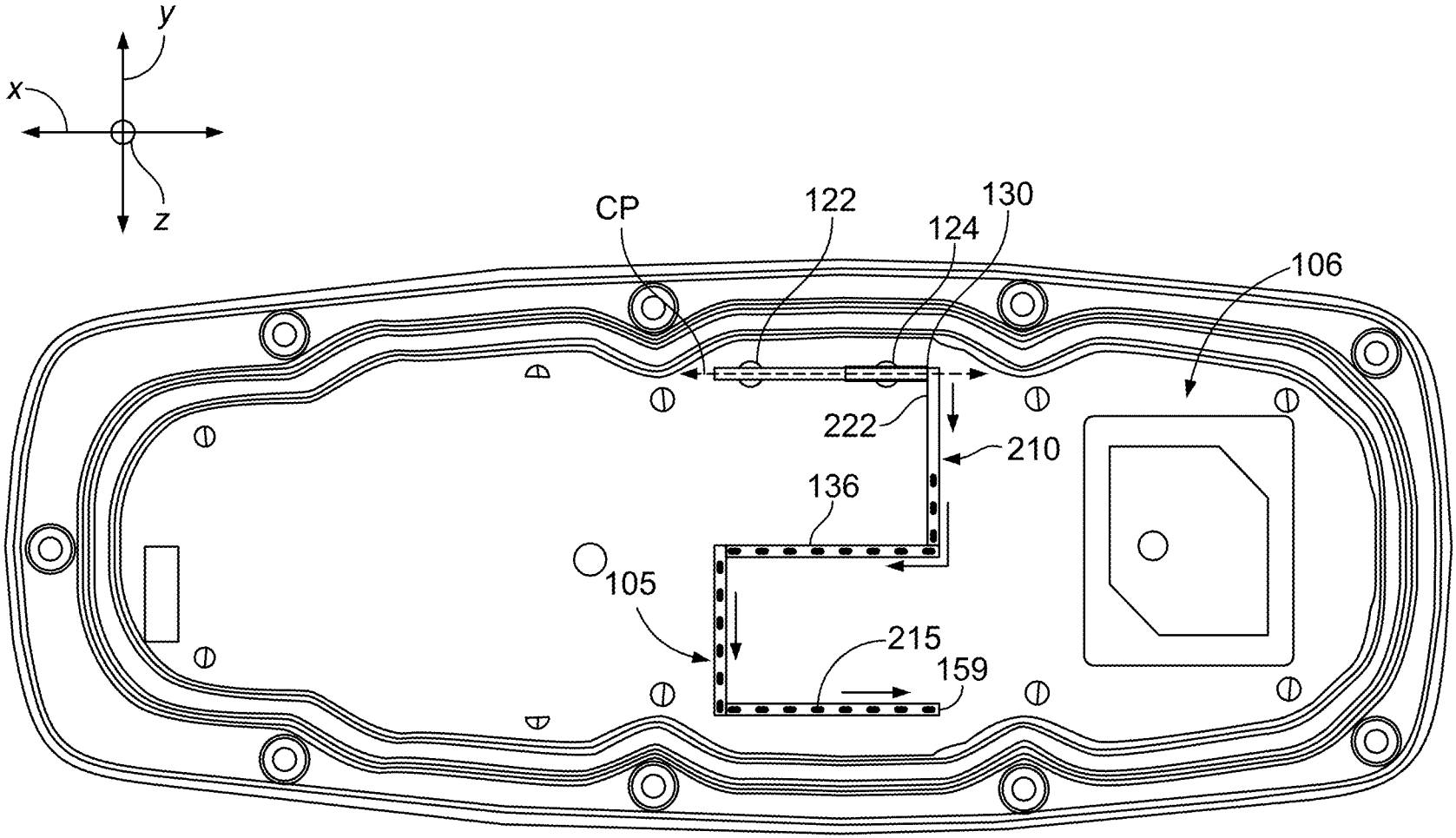
FIG. 3 is a plan view of a portion of the communication system of FIG. 1 illustrating a spatial relationship between the 3D-IFA element and an adjacent antenna element.

The coupling section 130 includes portions of the 3D-IFA element 105 that are electrically connected to the remainder of the communication system 100. More specifically, the coupling section 130 includes a feed terminal 132 and a ground terminal 134. In the illustrated embodiment, each of the feed terminal 132 and the ground terminal 134 includes a respective edge of the 3D-IFA element 105. For example, the feed and ground terminals 132, 134 may be pin-shaped elements (not shown) that extend through respective openings of the base substrate 108. The feed terminal 132 is electrically connected (e.g., through soldering) to a communication line at the feed point 124 (FIG. 1), and the ground terminal 134 is electrically connected (e.g., through soldering) to the ground plane 120 (FIG. 1) at a ground point 122 (FIG. 3).

The coupling section 130 includes a base portion 140 and a leg portion 142. The leg portion 142, which may also be referred to as an elbow portion, extends from the base portion 140 along the X-axis and then toward the base substrate 108 along the Z-axis. The leg portion 142 has a distal edge 143. The distal edge 143 may define at least a part of the ground terminal 134. The base portion 140 has a distal edge 141 that may form or include the feed terminal 132. The coupling section 130 extends away from the ground plane 120 (FIG. 1), thereby increasing a distance that separates the one or more antenna arms from the ground plane 120.

In the illustrated embodiment, the coupling section 130 has a substantially planar or two-dimensional structure that extends parallel to the Z-axis and, in particular, a plane defined by the X- and Z-axes (referred to as the XZ plane). The coupling section 130 extends from and is coupled to the mounting surface 112.

As described herein, the 3D-IFA element 105 may include one or more antenna arms. In the illustrated embodiment, the 3D-IFA element 105 includes a first antenna arm 136 and a second antenna arm 138. The first antenna arm 136 has first and second elevated edges 152, 154 and opposite first and second broad sides 156, 158. A width $W_1$ of the first antenna arm 136 is defined between the first and second elevated edges 152, 154. A distal edge 159 defines an end of the first antenna arm 136. In other embodiments, the 3D-IFA element may have only one antenna arm (e.g., the antenna arm 136).

In the illustrated embodiment, the second antenna arm 138 is co-planar with respect to the coupling section 130. The second antenna arm 138 has first and second elevated edges 162, 164 and opposite first and second broad sides 166, 168. A width $W_2$ of the second antenna arm 138 is defined between the first and second elevated edges 162, 164. A distal edge 169 forms an end of the second antenna arm 138.

Unlike PIFA elements in which the receiving and/or transmitting arms extend parallel to the ground plane, the 3D-IFA element 105 may include one or more arms that are oriented to be orthogonal or perpendicular to the ground plane 120. More specifically, each of the first and second antenna arms 136, 138 is oriented to be orthogonal or perpendicular to the ground plane 120 and a plane defined by the X- and Y-axes (referred to as an XY plane). As such, the first and second broad sides 156, 158 of the first antenna arm 136 and the first and second broad sides 166, 168 of the second antenna arm 138 extend along the Z-axis. In the illustrated embodiment, the first and second broad sides 156, 158 and the first and second broad sides 166, 168 extend parallel to the Z-axis for an entirety of the respective first and second antenna arms 136, 138.

In the illustrated embodiment, the 3D-IFA element 105 is secured to the mounting surface 112 and is essentially freestanding. In other embodiments, a dielectric carrier may be used to support at least a portion of the 3D-IFA element. For example, a block-shaped dielectric carrier may extend along and support the first elevated edge 154. The coupling section 130 may extend along a wall of the dielectric carrier.

Due to the orientations and shapes of the first and second antenna arms 136, 138, the first and second elevated edges of the respective antenna arm have different elevations (or heights) relative to the ground plane 120. More specifically, the first elevated edges 152, 162 are located closer to the ground plane 120 than the second elevated edges 154, 164. A separation distance S exists between the first elevated edges 152, 162 and the mounting surface 112. The separation distance S is equal for each of the first elevated edges 152, 162, but may be different in other embodiments. Returning briefly to FIG. 1, the antenna section 107 of the antenna element 106 is positioned at an elevation measured along the Z-axis that is less than an elevation of the first elevated edge 152. The first elevated edge 152 is closer to the ground plane 120 than the second elevated edge 154.

Returning to FIG. 2A, in the illustrated embodiment, the first elevated edges 152, 162 are co-planar and extend parallel to the XY plane (or the ground plane 120). Likewise, the second elevated edges 154, 164 are co-planar and extend parallel to the XY plane (or the ground plane 120). In other embodiments, however, the first elevated edges 152, 162 are not co-planar and/or the second elevated edges 154, 164 are not co-planar.

In the illustrated embodiment, the first antenna arm 136 has a non-planar shape such the first antenna arm 136 takes a meandering arm path from the coupling section 130 to the distal edge 159. For instance, the first antenna arm 136 includes a first arm section 201, a second arm section 202, a third arm section 203, and a fourth arm section 204 that are interconnected to one another through corners or joints where the first antenna arm 136 is bent. The first arm section 201 extends between joints 211, 212, the second arm section 202 extends between the joint 212 and a joint 213, the third arm section 203 extends between the joint 213 and a joint 214, and the fourth arm section 204 extends between the joint 214 and the distal edge 159. Each of the first, second, third, and fourth arm sections 201-204 is essentially planar in the illustrated embodiment. In particular embodiments, the 3D-IFA element 105 includes a conductive sheet 125 that has the first and second antenna arms 136 and the coupling section 130. The conductive sheet 125 is folded along the first antenna arm 136 such that the first antenna arm 136 includes the multiple arm sections 201-204 in which adjacent arm sections are coupled by one of the joints.

Although each of the first, second, third, and fourth arm sections 201-204 are essentially planar in FIG. 2A, the joints 211-214 allow a meandering path from the coupling section 130 to the distal edge 159. For example, the broad side 156 at any point along the surface of the broad side 156 has a vector that defines the direction at which the broad side 156 is facing. At different points along the broad side 156, the X-components, Y-components, and Z-components of the vector may be different. For instance, the broad side 156 along the first arm section 201 faces along the X-axis and has a vector of (1, 0, 0). The broad side 156 along the second arm section 202 faces along the Y-axis and has a vector of (0, 1, 0). The broad side 156 along the third arm section 203 faces along the X-axis and has a vector of (1, 0, 0). The broad side 156 along the fourth arm section 204 faces along the Y-axis and has a vector of (0, −1, 0). The second and fourth arm sections 202, 204 oppose each other with a space therebetween.

In FIG. 2A, the antenna arm 136 is essentially upright and oriented perpendicular to the XY plane. In other embodiments, however, at least a portion of the antenna arm 136 may not be oriented perpendicular to the XY plane. For example, the first and second broad sides 166, 168 may form a non-orthogonal angle with respect to the XY plane. For example, the broad side 156 along the first arm section 201 may face partially along the X-axis and partially along the Z-axis and have a vector of (1, 0, 1).

Also shown in FIG. 2A, the first elevated edges 152, 162 and the second elevated edges 154, 164 extend parallel to the XY plane. In other embodiments, the first elevated edges 152, 162 and/or the second elevated edges 154, 164 may at least partially toward or at least partially away from the XY plane. Accordingly, the phrase "along the XY plane [or the ground plane]" does not require that the element (e.g., antenna arm or elevated edge) to extend parallel to the XY plane. At least a portion of the element may extend partially toward or partially away from the XY plane.

As shown in FIG. 2A, the joints 211-214 of the 3D-IFA element 105 may be abrupt such that a right-angle (or other angle) is formed with respect to two adjacent arm sections. In other embodiments, however, at least a portion of the 3D-IFA element 105 may have a curved contour. For example, the meandering path may be a serpentine path in which the antenna arm 136 curves without an abrupt bend. More specifically, at least a portion of the antenna arm 136 extending from the coupling section 130 may be C-shaped or S-shaped. In FIG. 2A, the antenna arm 136 extending from the coupling section 130 is hook-shaped. More specifically, the planar arm sections 201-204 are bent such that the antenna arm is hook-shaped. In other embodiments, the antenna arm 136 may have the planar arm section 201 and the remaining portion may be C-shaped with a section that curves from the joint 212 to the distal edge 159. Yet in other embodiments, the antenna arm 136 may have other meandering shapes.

From the feed terminal 132, the 3D-IFA element 105 extends along the z-axis to the maximum height H. The first and second antenna arms 136, 138 project in different directions that are perpendicular to each other. As shown in FIG. 2A, the first antenna arm 136 extends along the Y-axis away from the coupling section 130 for the first arm section 201. The second arm section 202 then extends along the X-axis away from the antenna element 106 (FIG. 1). The third arm section 203 then extends along the Y-axis away from the coupling section 130. The fourth arm section 204 then extends along the X-axis back toward the antenna element 106. Accordingly, the first antenna arm 136 meanders (e.g., moves back and forth) along the XY plane.

With the coupling section 130, the first and second antenna arms 136, 138 may be configured to satisfy communication within the designated bands. The first antenna arm 136 may enable resonance for lower bands. By way of example, the maximum height H may be 24 millimeters (mm). A total length measured from the feed terminal 132 to the distal edge 159 may be configured to be about a quarter-wavelength of a designated band. For example, the length of the first antenna arm 136 measured from the joint 211 to the distal edge 159 may be between about 107 mm and 83 mm for 700-900 MHz. Moreover, for higher bands, the first antenna arm 136 may form a current null within the first arm section 201. The distance between the current null and the distal edge 159 may determine a half-wavelength standing wave that communicates in higher bands. In the illustrated embodiment, the current null enables the first antenna arm 136 to communicate within an LTE higher frequency band. The standing wave may contribute a CP component. In the illustrated embodiment, the standing wave formed by the first antenna arm 136 contributes a RHCP component.

The length of the second antenna arm 138 is configured for communicating in a higher band. For example, the length of the second antenna arm 138 from the coupling section 130 to the distal edge 169 may be about 38 mm for 2000 MHz band. However, it should be understood that FIG. 2A and the above description provide just one example of how the 3D-IFA element 105 may be designed. It should be understood that the 3D-IFA element 105 may be modified to achieve a different performance.

Figure 2B:
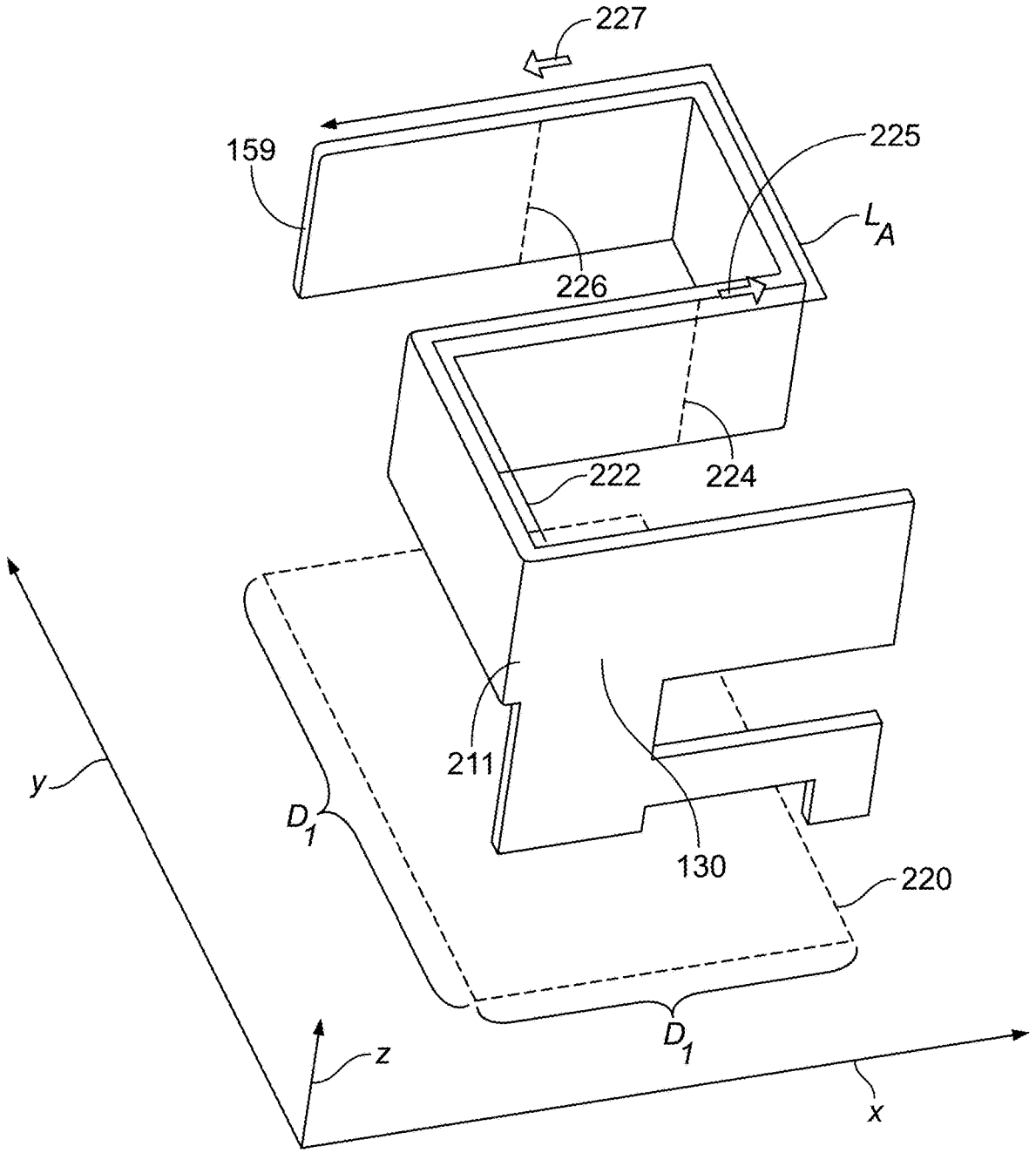
FIG. 2B illustrates a maximum area of the 3D-IFA element along an XY plane and how an antenna arm of the 3D-IFA element has a non-linear arm path along the XY plane.

FIG. 2B illustrates a maximum area 220 of the 3D-IFA element 105 along the XY plane. As shown, the first antenna arm 136 follows an arm path 222 along the XY plane as the first antenna arm 136 extends from the coupling section 130 to the distal edge 159 of the first antenna arm 136. The arm path 222 is non-linear along the XY plane. For example, the arm path 222 has a first path direction 225 along the XY plane at a first cross-section 224 of the first antenna arm 136. The arm path 222 also has a second path direction 227 along the XY plane at a second cross-section 226 of the first antenna arm 136.

In some embodiments, the first and second path directions 225, 227 may be at least perpendicular with respect to each other. For instance, in the illustrated embodiment, the first and second path directions 225, 227 are opposite directions. In other embodiments, however, the first and second path directions 225, 227 may be approximately opposite directions such that planes extending parallel to the first and second path directions intersect each other at an angle that is at most 30 degrees. Yet in other embodiments, the first and second path directions 225, 227 may be perpendicular to each other such that the first antenna arm 136 is L-shaped.

As shown in FIG. 2B, the maximum area 220 defines a maximum width $D_2$ and a maximum depth $D_1$ of the 3D-IFA element 105. The maximum depth $D_1$ is greater than the maximum width $D_2$. The non-linear arm path 222 may allow smaller maximum areas along the XY plane. For example, the first antenna arm 136 has a length $L_A$ that is at least two times (2×) the maximum depth $D_1$ of the 3D-IFA element 105. The length $L_A$ is measured from the joint 211 to the distal edge 159 along the first antenna arm 136.

FIG. 3 is a plan view of a portion of the communication system of FIG. 1 illustrating the three-dimensional structure of the 3D-IFA element 105. As shown, the coupling section 130 electrically connects to the ground plane through the short point 122 and electrically connects to the communication line through the feed point 124. The coupling section 130 extends along a section plane CP that intersects the short point 122 and the feed point 124. The coupling section 130 extends away from the short and feed points 122, 124 along the Z-axis. Also shown, the antenna arm 136 extends lengthwise from the coupling section 130 along the XY plane. The antenna arm 136 follows the arm path 222 along the XY plane as the antenna arm 136 extends from the coupling section 130 to the distal edge 159. The arm path 222 is non-linear along the XY plane and at least a portion of the arm path 222 extends away from the section plane CP.

FIG. 3 also illustrates a spatial relationship between the 3D-IFA element 105 and the adjacent antenna element 106. As shown, the first antenna arm 136 follows a meandering path (indicated by the arrows) as the first antenna arm 136 extends from the coupling section 130 to the distal edge 159. More specifically, the first antenna arm 136 extends away from the antenna element 106 and back toward the antenna element 106 as the first antenna arm 136 extends along the meandering path.

As described herein, the first antenna arm 136 may have a designated length such that a current null 210 exists within the first arm section 201 along the first antenna arm 136. As such, a half-wavelength standing wave for a designated frequency in the LTE higher frequency bands is formed along a portion of the first antenna arm 136 (the portion is indicated by dashed line 215) between the current null 210 and the distal edge 159. The structure of the first antenna arm 136 for this portion 215 provides a designated circular polarization component (e.g., right-hand circular polarization (RHCP) component). For embodiments in which the antenna element 106 has a designated CP component, the CP component of the first antenna arm 136 may be opposite the circular polarization of the adjacent antenna element 106.

Figure 5:
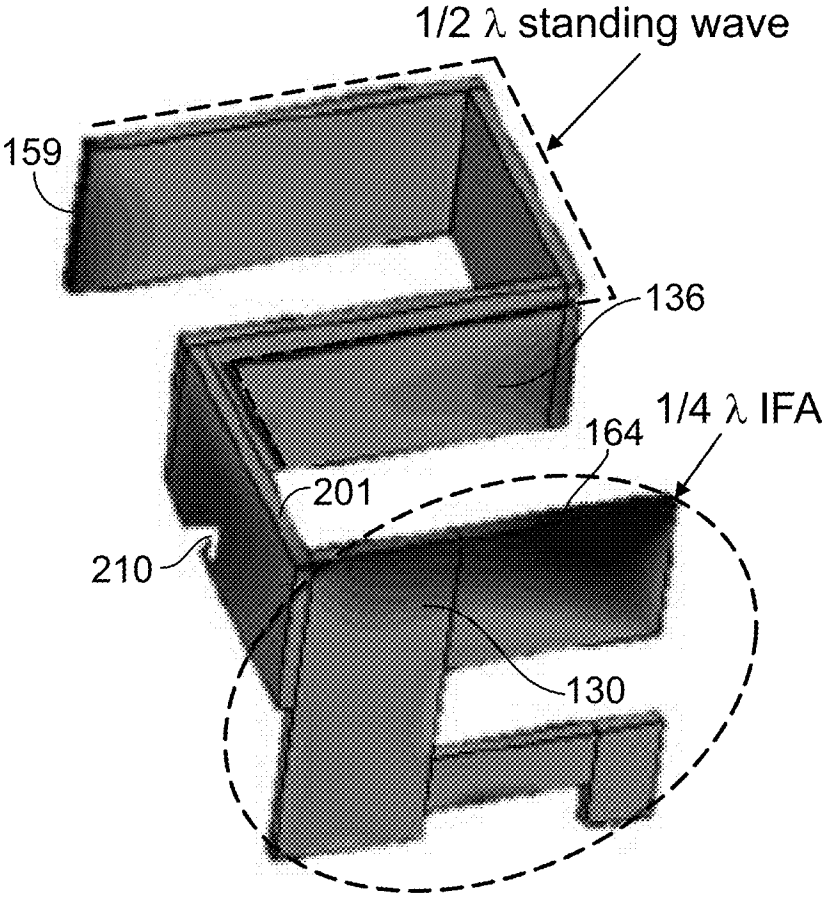
FIG. 5 illustrates a simulated current distribution for the 3D-IFA element of FIG. 2A at 2000 MHz
Figure 4:
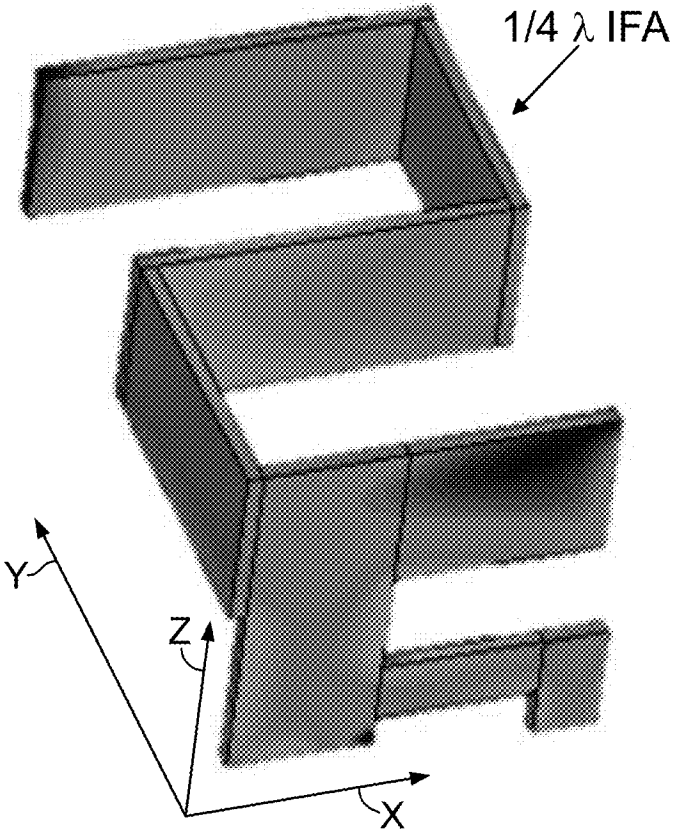
FIG. 4 illustrates a simulated current distribution for the 3D-IFA element of FIG. 2A at 800 megahertz (MHz).

FIG. 4 illustrates a simulated current distribution for the 3D-IFA element 105 at 800 MHz. FIG. 5 illustrates a simulated current distribution for the 3D-IFA element 105 at 2000 MHz. The degree of the shade on the 3D-IFA element 105 represents the intensity of the current distribution on the antenna. The shade become darker as the current distribution decreases. In the illustrated embodiment, the standing wave formed along the first antenna arm 136 at 2000 MHz is half-wavelength standing wave having a right-hand design. This half-wavelength standing wave may radiate and contribute a RHCP component. As shown in FIG. 5, the current null 210 exists within the first arm section 201 of the first antenna arm 136, and the standing wave at 2000 MHz is formed between the current null 210 and the distal edge 159.

In some embodiments, the 3D-IFA element 105 may also form a quarter-wavelength IFA that is vertically polarized. For example, the coupling section 130 extending from the feed point to the second elevated edge 164 may form another quarter-wavelength IFA that is vertically polarized. Vertical polarization in a vertical plane is also orthogonal to a circular polarization in a horizontal plane. Although a CP component is generated by the curved half-wavelength standing wave, the quarter-wavelength IFA in FIG. 5 near the IFA feed point may be the main radiator of the 3D-IFA element. In the illustrated embodiment, the vertical polarization component generated by the quarter-wavelength IFA is the dominant polarization component, especially in the low elevation directions.

Figure 6:
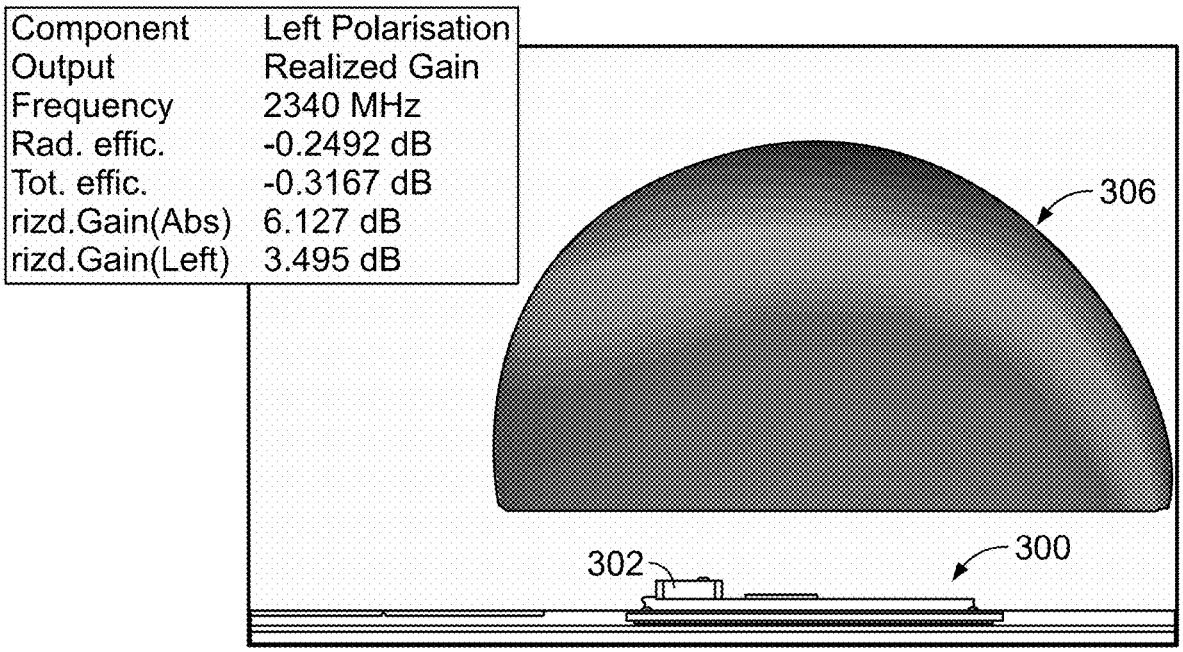
FIG. 6 illustrates a left-hand circular polarization (LHCP) component radiation pattern of the adjacent antenna element alone.
Figure 7:
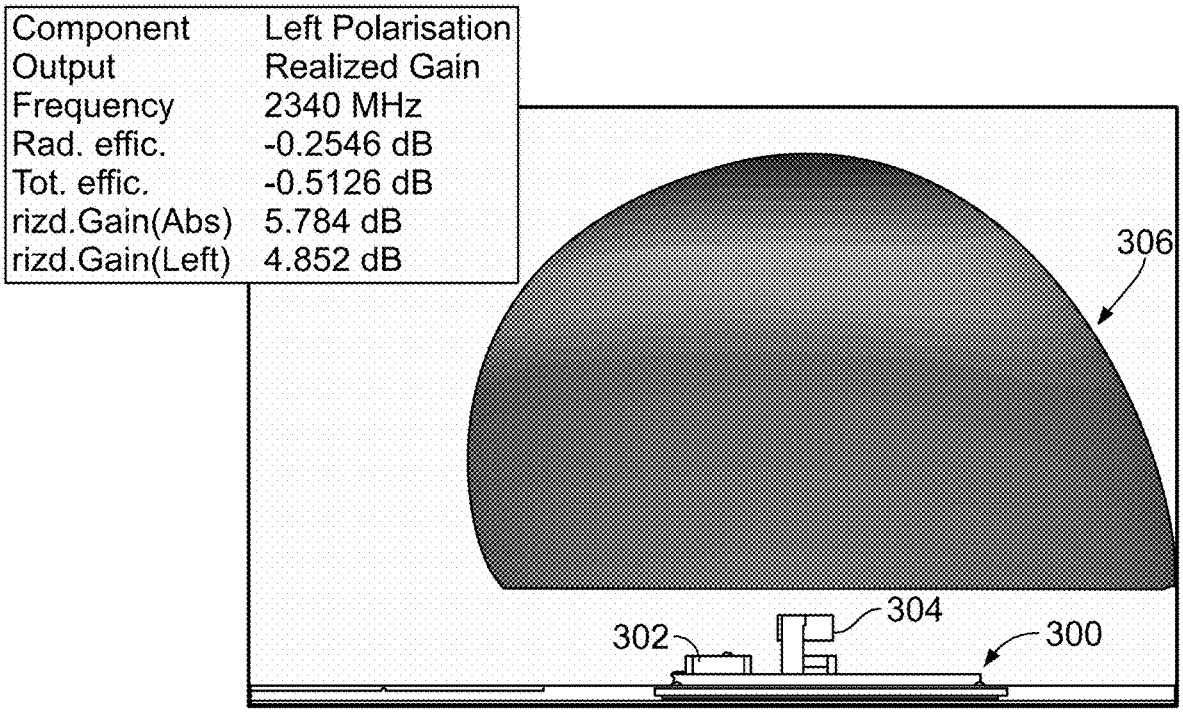
FIG. 7 illustrates the LHCP component radiation pattern of the adjacent antenna element and the 3D-IFA element.
Figure 8:
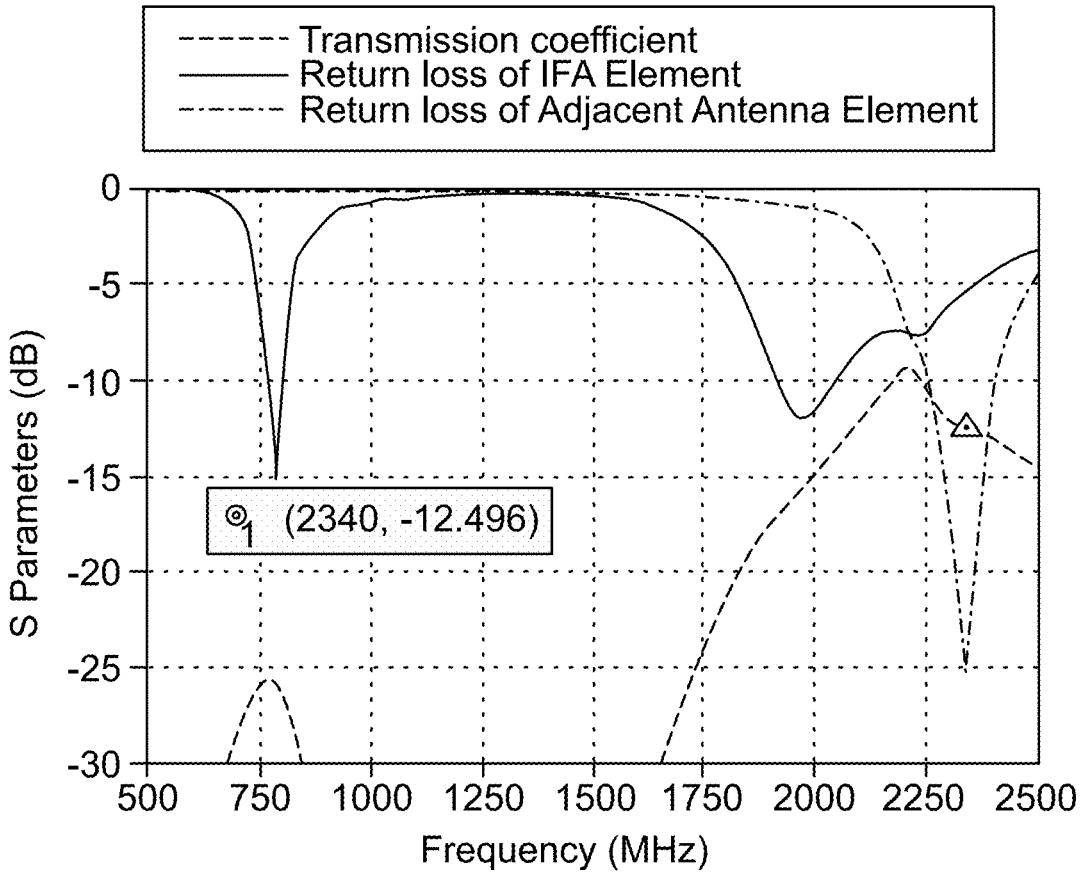
FIG. 8 illustrates S-parameters of the 3D-IFA element and the adjacent antenna element in accordance with one embodiment.

FIGS. 6-8 correspond to a communication module 300 formed in accordance with an embodiment that includes an adjacent antenna element 302 (e.g., satellite antenna element) and a 3D-IFA element 304. The 3D-IFA element 304 may be similar or identical to the 3D-IFA elements described herein. In the illustrated embodiment, the 3D-IFA element is identical to the 3D-IFA element 105 (FIG. 1). The communication module 300 may be similar or identical to the communication system 100 (FIG. 1). FIGS. 6 and 7 illustrate, in particular, a change of a LHCP radiation pattern 306 of the adjacent antenna element after the 3D-IFA element is installed in the communication module. FIG. 6 shows the LHCP radiation pattern 306 at 2340 MHz with the adjacent antenna element 302 alone, and FIG. 7 shows the LHCP radiation pattern 306 at 2340 MHz with the adjacent antenna element 302 and the 3D-IFA element 304.

FIG. 8 illustrates that the 3D-IFA element 304, which includes a vertical and meandering antenna arm, has minimal impact on the adjacent antenna element 302. As shown, the return loss of the adjacent antenna element matches well across a designated band defined between 2332.5 MHz and 2345 MHz. The transmission coefficient between the 3D-IFA element and the adjacent antenna element is below −10 dB within the designated band. The return loss of the 3D-IFA element 304 is also shown. Accordingly, embodiments may provide a 3D IFA element that impacts an adjacent antenna element compared to known designs. In particular embodiments, the 3D-IFA element is a secondary LTE antenna and the adjacent antenna element is a SDARS antenna.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The patentable scope should, therefore, be determined with reference to the appended claims, along with the full scope of equivalents to which such claims are entitled.

As used in the description, the phrase "in an exemplary embodiment" and the like means that the described embodiment is just one example. The phrase is not intended to limit the inventive subject matter to that embodiment. Other embodiments of the inventive subject matter may not include the recited feature or structure. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. § 112(f), unless and until such claim limitations expressly use the phrase "means for" followed by a statement of function void of further structure.

What is claimed is:

1. A three-dimensional inverted-F antenna (3D-IFA) element oriented with respect to mutually perpendicular X-, Y-, and Z-axes, the 3D-IFA element comprising:

a coupling section that is configured to electrically connect to a ground plane through a short point and electrically connect to a communication line through a feed point, the coupling section extending along a section plane that intersects the short point and the feed point, the coupling section extending away from the short and feed points along the Z-axis; and an antenna arm extending lengthwise from the coupling section along an XY plane, wherein the antenna arm follows an arm path along the XY plane as the antenna arm extends from the coupling section to a distal edge of the antenna arm, the arm path being non-linear along the XY plane, wherein at least a portion of the arm path extends away from the section plane;

wherein the antenna arm includes opposite broad sides that extend along the Z-axis and provide the antenna arm with an orthogonal orientation with respect to the XY plane, the non-linear arm path of the antenna arm causing the broad sides to be non-planar while the broad sides remain generally orthogonal to the XY plane.

2. The 3D-IFA element of claim 1, wherein the arm path has a first path direction along the XY plane at a first cross-section of the antenna arm and has a second path direction along the XY plane at a second cross-section of the antenna arm, the first and second path directions being at least perpendicular with respect to each other.

3. The 3D-IFA element of claim 2, wherein the first and second path directions are opposite path directions or approximately opposite path directions.

4. The 3D-IFA element of claim 1, wherein the antenna arm has a designated length such that a current null exists along the antenna arm for a designated frequency band of the 3D-IFA element, wherein the antenna arm is configured to provide a circular polarization component when a standing wave exists between the current null and the distal edge.

5. The 3D-IFA element of claim 1, wherein the 3D-IFA element has a maximum area along the XY plane that defines a maximum width and a maximum depth of the 3D-IFA element, the maximum depth being greater than the maximum width, wherein the antenna arm has a length that is at least two times (2×) the maximum depth of the 3D-IFA element.

6. The 3D-IFA element of claim 1, wherein the antenna arm has a first elevated edge and a second elevated edge with the broad sides extending between the first and second elevated edges, the first and second elevated edges having different elevations with respect to the ground plane, wherein the first elevated edge is closer to the ground plane than the second elevated edge, the first elevated edge extending parallel to the XY plane, the coupling section extending between the first elevated edge and the ground plane along the Z-axis.

7. The 3D-IFA element of claim 1, wherein the antenna arm has a first elevated edge and a second elevated edge with the broad sides extending between the first and second elevated edges, the first and second elevated edges having different elevations with respect to the ground plane, the 3D-IFA element further comprising a conductive sheet that includes the antenna arm and the coupling section, the conductive sheet being folded along the antenna arm such that the antenna arm includes multiple arm sections in which adjacent arm sections are coupled by a joint.

8. The 3D-IFA element of claim 1, wherein the antenna arm is a first antenna arm and the 3D-IFA element includes a second antenna arm, the first and second antenna arms extending separately from the coupling section in different directions.

9. An antenna assembly comprising:

a ground plane;

an adjacent antenna element configured to transmit/receive energy for communicating wirelessly; and a three-dimensional inverted-F antenna (3D-IFA) element oriented with respect to mutually perpendicular X-, Y-, and Z-axes, the 3D-IFA element comprising:

a coupling section that is configured to electrically connect to the ground plane through a short point and electrically connect to a communication line through a feed point, the coupling section extending along a section plane that intersects the short point and the feed point, the coupling section extending away from the short and feed points along the Z-axis; and an antenna arm extending lengthwise from the coupling section along an XY plane, wherein the antenna arm follows an arm path along the XY plane as the antenna arm extends from the coupling section to a distal edge of the antenna arm, the arm path being non-linear along the XY plane, wherein at least a portion of the arm path extends away from the section plane;

wherein the antenna arm includes opposite broad sides that extend along the Z-axis and provide the antenna arm with an orthogonal orientation with respect to the XY plane, the non-linear arm path of the antenna arm causing the broad sides to be non-planar while the broad sides remain generally orthogonal to the XY plane.

10. The antenna assembly of claim 9, wherein the arm path has a first path direction along the XY plane at a first cross-section of the antenna arm and has a second path direction along the XY plane at a second cross-section of the antenna arm, the first and second path directions being at least perpendicular with respect to each other, the first and second cross-sections each including the broad sides of the antenna arm.

11. The antenna assembly of claim 9, wherein the antenna arm has a designated length such that a current null exists along the antenna arm for a designated frequency band of the 3D-IFA element.

12. The antenna assembly of claim 9, wherein the 3D-IFA element has a maximum area along the XY plane that defines a maximum width and a maximum depth of the 3D-IFA element, the maximum depth being greater than the maximum width, wherein the antenna arm has a length that is at least two times (2×) the maximum depth of the 3D-IFA element.

13. The antenna assembly of claim 9, wherein the 3D-IFA element and the adjacent antenna element are configured to communicate within respective frequency bands that are separated by less than 20 MHz.

14. A communication module configured to be positioned along an exterior of a vehicle, the communication module comprising:

a primary antenna element configured to be operable for receiving and transmitting communication signals within one or more cellular frequency bands;

a secondary antenna element configured to be operable for receiving communication signals within one or more cellular frequency bands; and a satellite antenna element configured to be operable for receiving communication signals within a satellite frequency band, the satellite antenna element being positioned adjacent to the secondary antenna element, the satellite antenna element having an antenna section;

wherein the primary antenna element, the secondary antenna element, and the satellite antenna element are oriented with respect to mutually perpendicular X-, Y-, and Z-axes, the antenna section of the satellite antenna element extending parallel to an XY plane; and wherein the secondary antenna element has a three-dimensional inverted-F antenna (3D-IFA) antenna element, the 3D-IFA antenna element comprising:

a coupling section that is configured to electrically connect to a ground plane through a short point and electrically connect to a communication line through a feed point, the coupling section extending along a section plane that intersects the short point and the feed point, the coupling section extending away from the short and feed points along the Z-axis; and an antenna arm extending lengthwise from the coupling section along an XY plane, wherein the antenna arm follows an arm path along the XY plane as the antenna arm extends from the coupling section to a distal edge of the antenna arm, the arm path being non-linear along the XY plane, wherein at least a portion of the arm path extends away from the section plane; and wherein the secondary antenna element has a respective polarization and the satellite antenna element also has a respective polarization, the respective polarization of the secondary antenna element being orthogonal to the respective polarization of the satellite antenna element.

15. The communication module of claim 14, further comprising a cover and a base plate that are coupled to one another, wherein the secondary antenna element, the satellite antenna element, and at least a portion of the primary antenna element are positioned within an interior space between the cover and the base plate.

16. The communication module of claim 15, wherein the cover has a maximum height that does not exceed 50 millimeters.

17. The communication module of claim 14, wherein the respective polarization of the secondary antenna element includes a circular polarization component of the 3D-IFA antenna element and the respective polarization of the satellite antenna element includes a circular polarization component that is opposite in direction to the circular polarization component of the 3D-IFA antenna element.

18. The communication module of claim 17, wherein the 3D-IFA element and the satellite antenna element are configured to communicate within respective frequency bands that are separated by less than 20 MHz.

19. The communication module of claim 14, wherein the antenna section of the satellite antenna element extends along the XY plane and wherein, as the antenna arm extends from the coupling section, the antenna arm extends along the Z-axis that is perpendicular to the XY plane.

20. The communication module of claim 19, wherein an entirety of the antenna arm from the coupling section to the distal edge is oriented orthogonal to the XY plane.

* * * * *